US010907264B2

(12) United States Patent
Zeng et al.

(10) Patent No.: US 10,907,264 B2
(45) **Date of Patent: *Feb. 2, 2021**

(54) EXTREME DURABILITY COMPOSITE DIAMOND ELECTRODES

(71) Applicant: Advanced Diamond Technologies, Inc., Romeoville, IL (US)

(72) Inventors: Hongjun Zeng, Naperville, IL (US); John Arthur Carlisle, Plainfield, IL (US); Ian Wakefield Wylie, Coquitlam (CA)

(73) Assignee: Advanced Diamond Technologies, Inc., Romeoville, IL (US)

( * ) Notice: Subject to any disclaimer, the term of this patent is extended or adjusted under 35 U.S.C. 154(b) by 8 days.

This patent is subject to a terminal disclaimer.

(21) Appl. No.: 15/179,337

(22) Filed: Jun. 10, 2016

(65) Prior Publication Data

US 2016/0362803 A1 Dec. 15, 2016

Related U.S. Application Data

(60) Provisional application No. 62/173,504, filed on Jun. 10, 2015.

(51) Int. Cl.
*C25B 11/12* (2006.01)
*C25B 11/04* (2006.01)
(Continued)

(52) U.S. Cl.
CPC ..... *C25B 11/12* (2013.01); *C25B 1/02* (2013.01); *C25B 1/13* (2013.01); *C25B 1/26* (2013.01);
(Continued)

(58) Field of Classification Search
CPC ..... C25B 11/00; C25B 11/04; C25B 11/0405; C25B 11/0442; C25B 11/0447;
(Continued)

(56) References Cited

U.S. PATENT DOCUMENTS 4,766,040 A 8/1988 Hillert et al.
5,955,155 A 9/1999 Yamamoto et al.
(Continued)

FOREIGN PATENT DOCUMENTS

WO WO 2012/142435 A2 10/2012
WO WO 2013/078004 A1 5/2013

OTHER PUBLICATIONS

Macpherson (Phys. Chem. Chem. Phys., 2014, 17, 2935) (Year: 2014).*

(Continued)

*Primary Examiner* — Alexander W Keeling
(74) *Attorney, Agent, or Firm* — Locke Lord LLP; Peter J. Fallon

(57) ABSTRACT

A durable composite diamond electrode is disclosed which comprise at least a relatively thicker conductive UNCD (Ultrananocrystalline Diamond) layer, with low deposition cost, on a substrate underlying a relatively thinner conductive MCD (Microcrystalline Diamond) layer. The electrode exhibits long life and superior delamination resistance under extremely stressed electrochemical oxidation conditions. It is hypothesized that this improvement in electrode reliability is due to a combination of stress relief by the composite film with the slightly "softer" underlying UNCD "root" layer and the electrochemically durable overlying MCD "shield" layer, an effective disruption mechanism of the fracture propagation between the compositing layers, and thermal expansion coefficient match between the diamond layers and the substrate. The diamond composite electrode can be applied to any electrochemical application requiring extreme voltages/current densities, extreme reliability or biomedical inertness such as electrochemical systems to generate ozone, hydroxyl radicals, or biomedical electrode applications.

32 Claims, 4 Drawing Sheets

(51) Int. Cl.

| | |
|---|---|
| ***C25B 1/13*** | (2006.01) |
| ***C25B 1/26*** | (2006.01) |
| ***C25B 1/28*** | (2006.01) |
| ***C25B 1/02*** | (2006.01) |

(52) U.S. Cl.
CPC ..... *C25B 1/28* (2013.01); *C25B 1/285* (2013.01); *C25B 11/041* (2013.01); *C25B 11/0405* (2013.01); *C25B 11/0478* (2013.01)

(58) Field of Classification Search
CPC ..... C25B 11/12; C02F 1/46109; C02F 2001/46133; C02F 2001/46138; C02F 2001/46147
See application file for complete search history.

(56) References Cited

U.S. PATENT DOCUMENTS

| | | | | |
|---|---|---|---|---|
| 6,447,843 | B1 | 9/2002 | Olson | |
| 6,592,839 | B2 | 7/2003 | Gruen et al. | |
| 6,620,210 | B2 | 9/2003 | Murphy et al. | |
| 7,311,977 | B2 * | 12/2007 | Yokota | C23C 16/0272 257/E29.004 |
| 7,384,693 | B2 | 6/2008 | Ravi | |
| 7,556,982 | B2 | 7/2009 | Carlisle et al. | |
| 7,563,346 | B2 | 7/2009 | Chen | |
| 8,101,273 | B2 | 1/2012 | Jacquet et al. | |
| 8,734,626 | B2 | 5/2014 | Arihara et al. | |
| 8,980,079 | B2 | 3/2015 | Yost, III et al. | |
| 2008/0160271 | A1 * | 7/2008 | Rueffer | C02F 1/46109 428/213 |
| 2009/0017258 | A1 | 1/2009 | Carlisle et al. | |
| 2009/0324810 | A1 * | 12/2009 | Serikawa | C02F 1/46109 427/78 |
| 2010/0129615 | A1 | 5/2010 | Chizik et al. | |
| 2011/0247929 | A1 | 10/2011 | Nagai et al. | |
| 2012/0168302 | A1 | 7/2012 | Kato et al. | |
| 2013/0213823 | A1 * | 8/2013 | Arumugam | G01N 27/3278 205/794.5 |
| 2013/0330529 | A1 | 12/2013 | Sato et al. | |
| 2014/0174942 | A1 | 6/2014 | Wylie et al. | |

OTHER PUBLICATIONS

Chaplin et a ("Characterization of the performance and failure mechanisms of boron-doped ultrananocrystalline diamond electrodes", Journal of Applied Electrochemistry, 2011, 41, pp. 1329-1340). (Year: 2011).*
Butler et al ("The CVD of Nanodiamond Materials", Chemical Vapor Deposition, 2008, 14, 145-160). (Year: 2008).*
J.V. Macpherson, "A practical guide to using boron doped diamond in electrochemical research," Phys. Chem. Chem. Phys., 17, pp. 2935-2949 (2014).
M. Panizza et al., "Electrochemical Polishing of Boron-Doped Diamond in Organic Media," Electrochemical and Solid-State Letters, 6(12), pp. D17-D19 (2003).
L.M. da Silva et al., "Boron Doped Ultrananocrystalline Diamond Films on Porous Silicon: Morphological, Structural and Electrochemical Characterizations," Materials Research, 18(6), pp. 1407-1413.
P. J. Pauzauskie et al., "Synthesis and characterization of a nonocrystalline diamond aerogel," PNAS, 108(21), pp. 8550-8553 (May 24, 2011).
V. Baranauskas et al., "Method of porous diamond deposition on porous silicon," Applied Surface Science, 185, pp. 108-113 (2001).
T. Kondo et al., "Micrometer-sized mesoporous diamond spherical particles," Diamond & Related Materials, 43, pp. 72-79 (2014.
F. Gao et al., "Highly porous diamond foam as a thin-film microsupercapacitor material," Carbon, 80, pp. 833-840 (2014).
C. Hébert et al., "Porous diamond with high electrochemical performance," Carbon, 90, pp. 102-109 (2015).
H. Zanin et al., "Porous Boron-Doped Diamond/Carbon Nanotube Electrodes," ACS Applied Materials & Interfaces, 6, pp. 990-995 (2014).
U.S. Appl. No. 15/801,759, filed Nov. 2, 2017, Zeng, Hongjun.
U.S. Appl. No. 15/167,363, filed May 27, 2016, Zeng, Hongjun.
Hongjun Zeng et al., "Diamond nanofeathers," Diamond & Related Materials, vol. 91, pp. 165-172 (2019).
A.C. Ferrari, et al., "Origin of the 1150-$cm^{-1}$ Raman mode in nanocrystalline diamond." The American Physical Society, vol. 63, pp. 121405-1-121405-4 (2001).
Alexander Kraft, "Doped Diamond: A Compact Review on a New, Versatile Electrode Material," International Journal of Electrochemical Science, vol. 2, pp. 355-385 (2007).
U.S. Appl. No. 15/189,380, filed Jun. 22, 2016, Carlisle, John.
U.S. Appl. No. 15/789,289, filed Oct. 20, 2017, Zeng, Hongjun.

* cited by examiner

EXTREME DURABILITY COMPOSITE DIAMOND ELECTRODES

CROSS-REFERENCE TO RELATED APPLICATION

This application is a Non-Provisional Application, which claims priority to Provisional Application No. 62/173,504, filed Jun. 10, 2015, which is hereby incorporated by reference in its entirety.

BACKGROUND OF THE INVENTION

This invention relates to a composition of matter for at least a multi-layer conductive diamond electrode deposited on a cost effective metal or semiconductor substrate, resulting in extraordinary durability, reliability, and resistance to failure under high current density/voltage and shear stress. The invention also describes diamond electrodes that resist oxidative electrochemical etching exceeding that of prior art polycrystalline diamond electrodes. The inventive diamond electrode can be utilized in any electrochemical application requiring extreme durability and reliability, but is particularly well suited for waste water treatment (electrochemical advanced oxidation processes, EAOP) and electrochemical ozonated water generation.

A superior electrode useful for electrochemical applications has the following characteristics: (1) Wide working potential window, high over-potentials for oxygen and hydrogen evolution; (2) Durability: ability to function for long periods in a wide range of electrochemical applications (oxidant generation, amperometric detection of redox-active target chemicals); (3) Pin-hole free thin films, isolation of the electroactivity to just that of the conducting diamond electrode surface, inhibition of electrode failure via delamination caused by deleterious electrochemical reactions at the diamond/substrate interface; (4) High current density operation, reduces the need for active electrode area thereby reducing the volume/space of the system infrastructure with the electrode and reducing the capital costs of the technology. High current density also increases the descale efficiency. (See "Electrochemical System And Method For On-Site Generation Of Oxidants At High Current Density, WO 2012142435 A2, to Ian W. Wylie et al.; and (5) Minimization of the total thickness of the diamond needed to meet cost, durability and lifetime specifications of the application.

Note that in theory only a few layers of diamond material deposited on a conducting substrate would enable limited function for these applications, but the current state of the technology does not allow this to be achieved effectively. This invention delivers electrode technology which meets the application criteria. Advanced Diamond Technologies Inc. (ADT) proprietary UNCD® (ultrananocrystalline diamond) enables much thinner diamond to be sufficiently durable, but this material alone does not exhibit optimal electrochemical properties for many water treatment applications. MCD (microcrystalline diamond) has superior electrochemical properties but this material alone does not meet the required durability, reliability, and economic needs for practical applications (i.e., its deposition time is typically substantially longer and more expensive). According to an embodiment, the innovation combines UNCD and MCD on various metal or silicon substrates, which provides products that exceed those based on either type of diamond individually.

For the purpose of clarifying the differences between UNCD and MCD films for electrochemical applications, MCD, with much larger grain sizes and with a structure with larger grain presence near the terminal surface, has a much smaller proportion of $sp^2$-bonded (graphitic) carbon at the surface. $Sp^2$-bonded carbon is more electroactive than $sp^3$-bonded (diamond) carbon at applied potentials below +/− about 3V. MCD films are also more resistant to oxidative processes that lead to active electrochemical etching of diamond in certain conditions, such as the applications involving high current densities in ordinary water (e.g., for ozone generation) or in the presence of organic acids, e.g., acetic acid ($C_2H_4O_2$) and oxalic acid ($C_2H_2O_4$), which are often encountered in waste water treatment applications (EAOP—Electrochemical Advanced Oxidation Processes).

UNCD films have superior adhesion (than MCD films) to metal and silicon electrode substrates due to a combination of small grain size, higher, as-deposited, tensile stress (leading to lower interfacial stress), and less differential stress in the film, in particular for thicker UNCD films.

In order to reduce cost and to improve compatibility with other materials, diamond coatings for electrodes must typically be integrated with conducting metal and/or silicon substrates. Ideally, these substrates support higher thermal expansion coefficients (compared to diamond thermal expansion coefficient). However, lower cost materials most often have characteristics generally unfavorable for the nucleation and adhesion of diamond to the substrates (i.e. not good carbide-forming materials). Further, as a useful electrode, the diamond film must be pin-hole free to avoid electrochemical reactions occurring at the diamond/substrate interface which can also lead to delamination of the film from the substrate. Then the diamond must be doped with boron or other dopant, such as nitrogen, in order to render it conductive. Finally, the surface of the diamond that will drive most of the electrochemical reactions, for which diamond is attractive, must consist of a large $sp^3$-bonded fraction, and not consist of large amounts of $sp^2$-bonded (graphitically bonded) carbon that can reduce the overpotential for oxygen evolution in water-based reactions or reduce the chemical inertness of the film that is important in all electrochemical applications including those that occur in aqueous environments.

Diamond is well known to be a hard material by those unskilled in the art. For those skilled in the art it is generally well known that the properties of diamond thin films grown using conventional chemical vapor deposition technologies can be adjusted and optimized for different electrochemical electrode applications. Choices of deposition chemistries can, for instance, dramatically change the conductivity or thermal conductivity of the electrode. In most cases engineering of the film for a particular property results in the diminishment of other important film properties. High thermal conductivity requires growth chemistries that yield larger diamond grains, which have an overall negative impact on the differential stress of the film and the cost as well, (i.e. slower deposition rates). Fine grain diamond materials that are well suited to achieve superior film adhesion and lower film stress yield very poor thermal conductivities and are also not optically transparent. Films grown to be highly thermally conductive are also very rough and cannot be used for applications that require low friction and high wear resistance. Therefore, there is a need to develop a novel diamond film and electrode composition which can simultaneously deliver extreme durability with an acceptable deposition cost.

DESCRIPTION OF THE RELATED ART

Diamond films have been deposited previously using many techniques and have been well characterized in terms of $sp^2$ (graphitic carbon) versus $sp^3$ (diamond) carbon content, grain size distribution, roughness, friction coefficient, Young's modulus, durability under extreme stress and many other key characteristics. For example, U.S. Pat. No. 7,556,982, to Carlisle et al., and U.S. Pat. No. 6,592,839, to Gruen et al., describe ultrananocrystalline diamond (UNCD) films comprised of pure $sp^3$ diamond grains of less than 10 nm average grain size independent of thickness. When correctly deposited, i.e. "phase pure," such UNCD films are typically comprised of less than 8% overall $sp^2$ carbon content, as characterized by NEXAFS (Near Edge X-Ray Absorption Fine Structure Spectroscopy), principally due to the $sp^2$ bonding between grains. Typical Young's moduli for such UNCD films vary between 550 and 900 GPa.

More traditional microcrystalline diamond (MCD) films, as for example in U.S. Pat. No. 4,766,040, to Hillert et al., typically exhibit grain sizes from 100 nm up to several microns in average grain size which increases with increasing film thickness during deposition. Such MCD films, when correctly deposited, i.e. "phase pure", usually exhibit less than 1% $sp^2$ carbon content because of the larger average grain size (less grain boundary) of these films as compared to UNCD. Chemical and electrochemical properties dependent upon $sp^2$ carbon content, such as oxidation resistance and surface catalysis, will therefore tend to differ when comparing the properties of UNCD and MCD. Typical Young's moduli for MCD films approach those of single crystal diamond and are in the range of 900-1200 GPa.

Other bilayer or multilayer composite diamond films are known in the art. For example, U.S. Pat. No. 5,955,155, to Yamato et al., describes a multi-layer diamond film of at least 20 μm in thickness with a combination of MCD layers of grain size 3-7 μm. U.S. Pat. No. 7,384,693, to K. V. Ravi, describes a two layer diamond-like carbon composite film with pores and nitrogen doping to reduce film stress. U.S. Pat. No. 7,563,346, to Chen, also describes a multi-layer composite diamond-like carbon film using an interfacial layer of amorphous carbon to improve bond strength to the underlying substrate. Finally, U.S. Pat. No. 8,101,273, to Jacquet et al., describes a multilayer nanostructure separated by many intervening layers of diamond-like carbon. However, the last patent uses many layers of diamond in order to act as barrier layers between the nanostructures.

Other diamond electrodes and methods of using them for ozone production and other high current density and high reliability applications are known in the art. For example, U.S. patent application Pub. No. 2014/0174942, to Wylie et al., "Electrochemical System and Method for On-Site Generation of Oxidants at High Current Density," by the current inventors and Arumugam, describes the basic 2 μm thick BD-MCD single layer electrodes used as the basis for improvement of the composite electrodes described in this invention. PCT patent application No. WO2013078004, to Wylie and Arumugam, "In Situ Regeneration of Diamond Electrodes after Anodic Oxidation" describes a method to extend the lifetime of diamond electrodes subject to extreme oxidative surface degradation through a series of short reverse polarity operations typically of duration less than 1% of the lifetime of the electrode. Such a method can also be used to extend the lifetime of diamond electrodes being used for ozone generation. Other prior art relevant to the use of diamond electrodes to generate ozone at high current density and systems using such electrodes include U.S. Pat. No. 8,734,626, to Arihara et al., "Electrode, Ozone Generation, and Ozone production Method", U.S. Pat. No. 8,980,079, to Yost et al., "Electrolytic Cell for Ozone Production", U.S. patent application Pub. No. 2012/168302, to Kato et al., "Ozone Generator", and U.S. patent application Pub. No. 2011/0247929, to Nagai et al., "Diamond electrode and method for manufacturing diamond electrode," and U.S. Pat. No. 6,620,210, to Murphy et al., "Method of washing laundry using ozone to degrade organic material." All of these patents and applications illustrate different approaches to improving diamond electrodes for application to electrochemical oxidation challenges including the generation of ozone and for the use of ozone in certain applications. Given the extreme current densities and local electric fields required for electrochemical ozone generation in aqueous solutions, they all illustrate the need for yet more reliability to allow such electrodes to operate without failure for an extended period and to reduce the cost of their manufacture.

SUMMARY OF THE INVENTION

The present invention seeks to simultaneously improve durability of composite diamond electrodes, the delamination resistance of diamond films deposited upon electrode substrates, to reduce the cost of durable diamond-coated electrodes, to decrease the relative roughness of thick diamond films and to provide thinner composite layers of similar or improved reliability over thicker single layer films. At least a bilayer approach as deposited on an electrode substrate is proposed to deliver this improvement. Ultrananocrystalline Diamond (UNCD) films are particularly favored as an underlying layer because of their high deposition rates, small grain sizes (high re-nucleation rates), their extremely low roughness which is not dependent upon thickness, their extreme chemical compatibility with other diamond films, and their somewhat lower brittleness due to their somewhat lower Young's modulus and larger internal grain surface areas. UNCD is also much more easily polished even to sub-nm average roughness because of the somewhat lower Young's modulus of UNCD films and the larger proportion of $sp^2$ carbon present in the film and most importantly because of the lower initial roughness (typically 5-8 nm) than MCD for example. Adjustment of the thickness of the underlying UNCD layer can be effected to optimize the stress relief and the other desired properties of the composite stack (such as radiation resistance and overall delamination resistance). An overlying layer of MCD is a superior choice due to its extreme chemical and biological inertness and its unsurpassed hardness. Given that the underlying layer can constitute the bulk of the thickness of the composite stack, the overlying layer can be much thinner and yet maintain a relatively high overall shear resistance of the composite stack. A thin MCD layer surface overlying a thick underlying UNCD layer as deposited on an electrode substrate thus delivers a robust combination of properties such as hardness, durability and chemical inertness appropriate for many different challenging applications in a composite diamond film based electrode that significantly outperforms the corresponding properties of a single (non-composite) layer-coated electrode.

DETAILED DESCRIPTION OF THE INVENTION

Figure 2A:
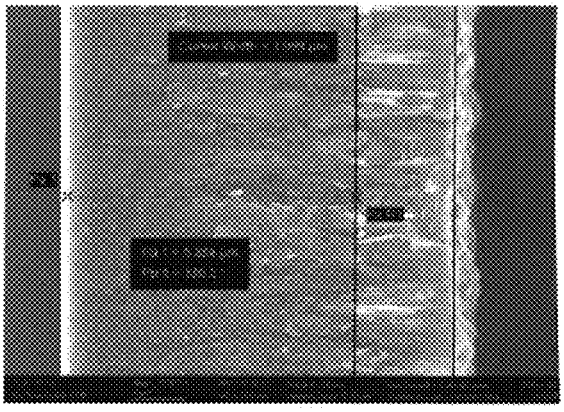
FIGS. 2*a* and 2*b* are a cross-sectional and top-view SEM micrographs, respectively, of an example of an embodiment of the invention with a 5.9 μm underlying layer of conductive UNCD and an overlying 2.0 μm layer of conductive MCD as deposited on an electrode substrate.

CVD (Chemical Vapor Deposition) and other diamond deposition techniques including PECVD (Plasma Enhanced Chemical Vapor Deposition) are well known in the art and these prior art techniques can be used to deposit doped diamond with various properties and thicknesses on select electrode substrates. Nitrogen or boron are typically used to dope the diamond for high conductivity. In the data shown here, all of the electrodes were doped with boron and therefore the film type is prefaced with the abbreviation "BD" (boron-doped). In FIG. 2*a*, prior art methods of depositions were used to deposit a first underlying (or "structural") BD-UNCD layer of approximately 6 μm in thickness. As in the prior art, a $CH_4/H_2$ mixture is used for the deposition with a methane ($CH_4$) to hydrogen ($H_2$) ratio of 1-10% and an approximate pressure in the range of 1-10 torr with boron doping gas flow (TMB-Trimethyl Borane, $BC_3H_9$) with a boron/carbon ratio between 500-12000 ppm. UNCD deposition rates of between 0.1-1.0 μm per hour were achieved depending upon the substrate deposition temperature in the range from 400-900° C. This BD-UNCD deposition was followed by an overlying BD-MCD layer deposition of approximately 2 μm in thickness. The MCD layer deposition is typically performed with a $CH_4/H_2$ mixture at a $CH_4$ to $H_2$ ratio of 0.1-1% at a pressure in the range of 10-100 torr with a TMB flow of roughly the same as the BD-UNCD deposition. MCD deposition rates for a substrate deposition temperature range from 400-900° C. can be as much as 10 times slower than those of UNCD.

Figure 1:
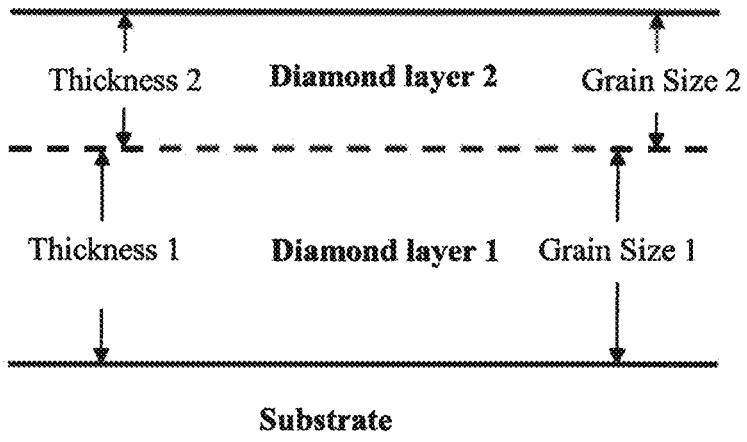
FIG. 1 is a schematic drawing of an embodiment of the invention with a thick underlying polycrystalline diamond layer with a small grain size and an overlying polycrystalline diamond layer with a larger grain size as deposited on an electrode substrate.

FIG. 1 shows a schematic representation of the inventive composite diamond film as deposited on an electrode substrate wherein the underlying diamond layer exhibits a significantly different grain size than the overlying diamond layer. In an embodiment, the first underlying diamond layer is comprised of BD-UNCD and the second overlying diamond layer is comprised of BD-MCD. Typical thicknesses of diamond layer 1 and diamond layer 2 are in the range of 2-10 μm and 1-5 μm respectively. Typical grain sizes of diamond layer 1 and diamond layer 2 are less than 10 nm and greater than 100 nm respectively.

The cross-sectional Scanning Electron Micrograph (SEM) of the inventive composite film as deposited on an electrode substrate shown in FIG. 2*a* clearly shows the underlying (structural) UNCD layer deposited on a smooth silicon wafer substrate (as example of an electrode substrate) and the overlying (functional) MCD layer deposited on top of the UNCD layer.

Figure 2B:
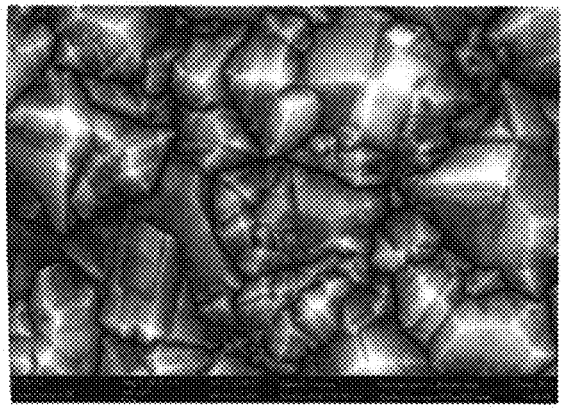

FIGS. 2*a* and 2*b* present an SEM images of (i.e., left—2*a*) cross-sectional view and (i.e., right—2*b*) top view, respectively, of an embodiment of the inventive composite diamond electrode. An underlying 5.9 μm thick BD-UNCD film with an average grain size of less than 10 nm is covered by a MCD film of approximately 2.0 μm in thickness. From the top view it can be seen that the BD-MCD layer has an average grain size of between approximately 0.2 μm and 2 μm.

FIGS. 2*a* and 2*b* present an SEM images of (i.e., left—2*a*) cross-sectional view and (i.e., right—2*b*) top view, respectively, of an embodiment of the inventive composite diamond electrode. An underlying 5.9 μm thick BD-UNCD film with an average grain size of less than 10 nm is covered by a MCD film of approximately 2.0 μm in thickness. From the top view it can be seen that the BD-MCD layer has an average grain size of between approximately 0.2 μm and 2 μm.

The inventive conductive composite diamond electrode was tested under Highly Accelerated Stress Test (HAST) conditions at high current density and with varying levels of chemical acceleration. The literature (e.g. Kraft, "Doped Diamond: A Compact Review on a New, Versatile, Electrode Material", Int. J. Electrochem. Sci., 2(2007) 355-385, p. 363), indicates that acetic acid ($C_2H_4O_2$) or "HAC" is highly effective at accelerating the electro-etching of doped diamond. Current density acceleration is a standard HAST technique for electrode testing in our lab and has indicated that lifetimes before delamination decrease in rough proportion to the cube of increasing current density over a range from 2.0-3.0 A/cm$^2$. Extrapolation of the lifetime to normal operating conditions was estimated to be a reasonable and conservative verification of HAST testing. Testing of previous single layer diamond electrodes (see Table 1) have indicated that this is a conservative estimate and that actual lifetimes to delamination at typical operating current densities, e.g. 0.15-0.50 A/cm$^2$, are in fact longer than would be predicted from a simple cube-law extrapolation. However, this extrapolation will be used in this invention since the current density typical of ozone applications, i.e. 1.0-2.0 A/cm$^2$, is much closer to the HAST conditions used for test to failure of the inventive electrodes and therefore the extrapolation will be less likely to diverge from the fitted cube law estimation.

Figure 4:
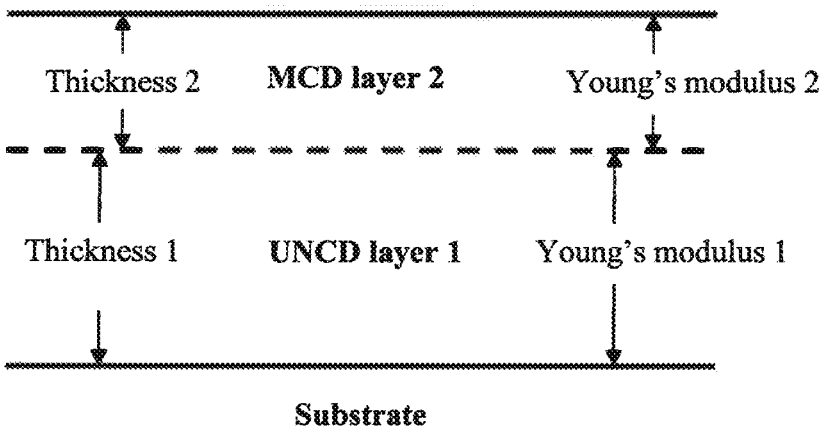
FIG. 4 is a schematic drawing of an embodiment of the inventive composite diamond film showing the respective Young's moduli of the two component diamond layers with the underlying BD-UNCD (boron-doped ultrananocrystalline diamond) layer with a lower Young's modulus than the overlying BD-MCD layer (boron-doped microcrystalline diamond) as deposited on an electrode substrate.

Acetic Acid Testing:

An extreme chemical acceleration of the delamination/electro-etching of the diamond electrodes was achieved with an aqueous solution comprising 0.3 M HAC, 0.1 M sulfuric acid ($H_2SO_4$), 0.1 M sodium perchlorate ($NaClO_4$). The diamond coated electrodes were exposed to this solution while being subject to a constant current density (in galvanostatic mode) of 0.5 A/cm$^2$ at roughly 40° C. (104° F.), with an electrode gap of roughly 1 cm, and an applied voltage varying in a range between 10-25V. Multiple electrodes were tested using this HAST protocol with a lifetime to failure defined by an ~3V increase in applied voltage which corresponded to an approximate delamination percentage of the diamond film electrode of 90-95% as observed in an optical microscope. The inventive electrodes with composite diamond film (5.5-μm thick BD-UNCD covered by 2-μm thick BD-MCD), tested with this method exhibited lifetime to delamination failure in the range of 50 to 60 Ahr/cm$^2$ (100-120 hours under test at 0.5 A/cm$^2$). See Table 1 for details. Testing using the same HAST protocol applied to previous generations of electrodes with a single layer of diamond deposited on the substrate, produced lifetimes to failure of roughly 5 to 7 Ahr/cm$^2$ (10-14 hours under test). Therefore the inventive conductive composite (2 layer: UNCD MCD) diamond electrodes as shown in FIG. 4, exhibited lifetimes to delamination failure of approximately 10 times greater than previous single layer electrodes using this extreme chemical acceleration HAST protocol.

Sodium Chloride (Salt Solution) Highly Accelerated Stress Testing:

A similar test regime was employed to that described above for HAC except that a 1M solution of sodium chloride (NaCl) was employed instead of HAC and the applied current density was much higher (2.5 A/cm$^2$). Other test conditions were the same as those listed above. Lifetimes to failure were as high as 8000 Ahr/cm$^2$ (corresponding to a time under test of >3200 hours) (see Table 1 for details). Such a test protocol was conducted before the HAC protocol, and is very time and labor costly, so we eventually used HAC protocol to evaluate the durability of electrodes. If a cube-law current density function of delamination lifetime is applied to this result for inorganic electrochemistry (e.g. solutions of NaCl or $H_2SO_4$), these lifetimes would correspond to a time to delamination failure of >342 years at a current density of 0.25 A/cm$^2$, >58 years at 0.45 A/cm$^2$ and >5 years at 1.0 A/cm$^2$. The actual lifetime of a single layer conductive diamond electrode being operated at 0.45 A/cm$^2$ has now been confined to be in excess of 2.0 years with only 60% delamination (i.e. it has not yet failed) which when compared to the cubed-law dependence would have failed at roughly 1.0 year, demonstrates that these single layer conductive diamond electrodes (and likely the inventive two layer conductive diamond electrodes) would last longer than a cube-law extrapolation as a function of current density would imply at these more "typical" current density operating conditions.

delamination failure in 1M NaCl alone, that lifetime testing was restricted to the chemical HAST conditions to allow actual times to delamination failure of less than 6 months. Using a very conservative acceleration factor based upon the cube law extrapolation and the 10,000 times chemical acceleration factor calculated approximately from the other rows in the table, which is itself conservative, the bottom row of Table 1 (5 μm BD-UNCD/2 μm BD-MCD) would be expected to last more than 10 years at 1 A/cm$^2$ under non-chemical acceleration conditions. 1 A/cm$^2$ is an extreme current density for many electrochemical applications. It should be noted that the inventive film 5 μm BD-UNCD and 2 μm BD-MCD electrode has a shorter deposition time (less expensive) than the single layer 4 μm prior art BD-MCD film also listed in Table 1. Note, all of these results were derived from HAST measurements of planar electrodes. The non-planar geometry of typical ozone electrodes (e.g. cylindrical holes in a Nb substrate coated with diamond) would be expected to experience localized areas of higher electric fields, which could lower the lifetime for ozone generation or other non-planar geometry electrode applications. Higher HAST lifetimes of planar diamond films are required (or recommended) to accommodate the reliability requirements of these more extreme conditions.

FIG. 2*b* presents a top view SEM of the inventive composite diamond electrode with BD-MCD gain formation clearly evident with a variable grain size in the approximate range of 0.2-2 μm whose HAST data is shown on the bottom line of Table 1. The diamond electrode comprising the underlying BD-UNCD layer and the overlying BD-MCD layer would exhibit an average roughness in the range of 20-100 nm if deposited on a smooth electrode substrate, such as a silicon wafer with typical average roughness in the range of 0.2-0.3 nm. A thicker film of MCD would increase the grain size and the roughness of the composite film and significantly increase the deposition time and cost. However,

TABLE 1

Highly Accelerated Stress Testing (HAST) on Diamond Electrodes with various thicknesses of Boron-Doped Ultrananocrystalline Diamond (BD-UNCD) and Boron-Doped Microcrystalline Diamond (BD-MCD) in current density accelerated and chemically accelerated HAST conditions:

| Diamond Deposition Parameters | HAST in 1M NaCl at 2.5 A/cm$^2$, 40° C. | HAST in 0.3M HAC, 0.1M $H_2SO_4$ at 0.5 A/cm$^2$, 40° C. (individual measurements) | HAST in 0.3M HAC, 0.1M $H_2SO_4$ at 0.5 A/cm$^2$, 40° C. (average) |
|---|---|---|---|
| 2.0 μm thick BD-UNCD | <100 Ahr/cm$^2$ (avg) | Dies almost immediately | ~0 |
| 5.0 μm thick BD-UNCD | 200-500 Ahr/cm$^2$ (avg) | Dies almost immediately | 0 |
| 2.0 μm thick BD-MCD | ~500 Ahr/cm$^2$ (avg) | 6.8, 3.8, 4.6, 5.2, 5.3, 5.6 Ahr/cm$^2$ | 5.2 Ah/cm$^2$ |
| 4.5 μm thick BD-MCD | 7678 Ahr/cm$^2$ | 17.5, 19.0 Ahr/cm$^2$ | 18.2 Ah/cm$^2$ |
| INVENTION: 5.0 μm thick BD-UNCD + 2 μm BD-MCD | >8000 AHr/cm$^2$ (still under test) | 45.5, 47.5, 56.3, 50.3, 48.5 Ahr/cm$^2$ | 49.6 Ah/cm$^2$ |

Table 1 presents representative data comparing the HAST under current density acceleration only ($2^{nd}$ column in Table 1) in 1M NaCl (58 g/L) at an extreme current density of 2.5 A/cm$^2$ as compared to ($3^{rd}$ and $4^{th}$ columns) both a mild current density acceleration (0.5 A/cm$^2$) and an extreme chemical acceleration in 0.3 M HAC, 0.1 $H_2SO_4$. HAC provides a much more extreme HAST condition. Given the lower current density an approximate calculation of the extra acceleration by HAC can be made from the $2^{nd}$, $3^{rd}$ and $4^{th}$ row of comparative data. This is not definitive, but the HAC acceleration factor is likely to be at least 10,000 times greater than current density alone, i.e. in 1M NaCl. The innovative composite diamond electrodes were so reliable to this is unnecessary since the inventive electrode delivers improved reliability results even with the faster deposition times conferred by the significant thickness of underlying structural BD-UNCD as deposited on an electrode substrates.

Figure 3:
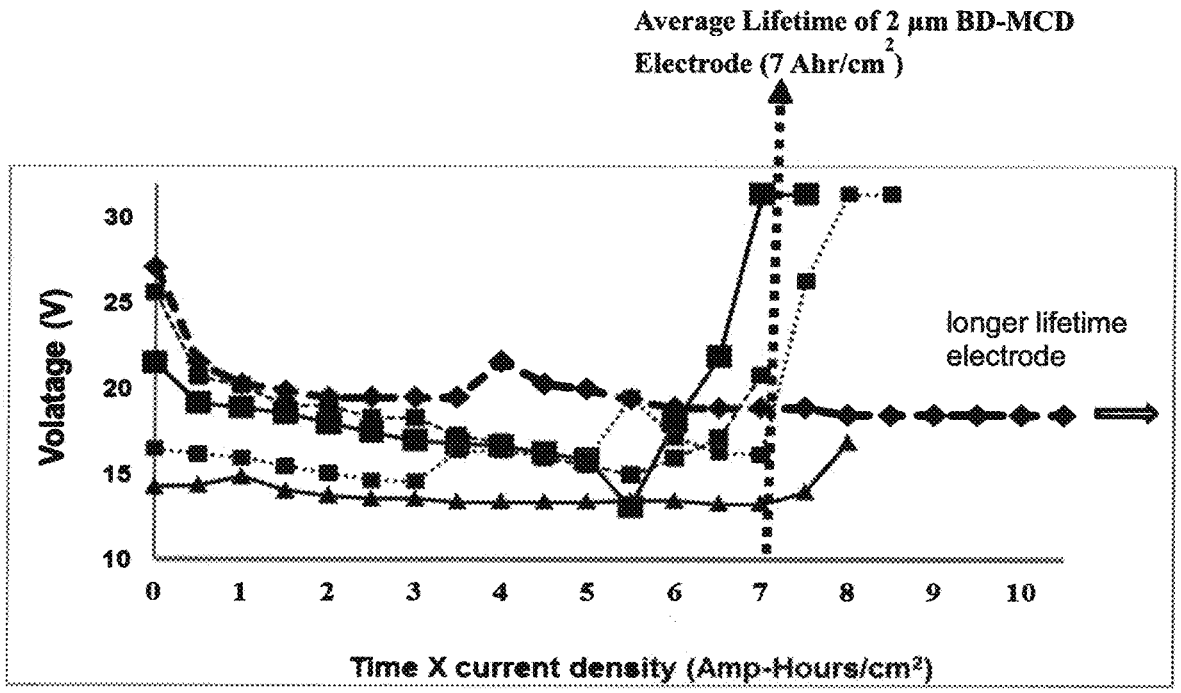
FIG. 3 is a graphic representation of Typical Highly Accelerated Stress Testing (HAST) voltage versus time testing of prior art 2 μm Boron Doped Microcrystalline Diamond (BD-MCD) electrodes in 0.3M acetic acid (HAC) and 0.1 $H_2SO_4$ at a current density of 0.5 A/cm$^2$.

FIG. 3 presents voltage versus time HAST data for four prior-art 2 μm thick BD-MCD electrodes and one set of data for the inventive longer life composite diamond electrode. This testing was conducted in the extreme chemical HAST conditions described above, i.e. 0.2 M HAC plus 0.1 M $H_2SO_4$ at a current density of 0.5 A/cm$^2$ and a temperature of ~40° C. This data is shown to illustrate the HAST method used to generate the data shown in Table 1 above. There is considerable scatter in the data but the overall average of these particular four electrodes is ~7 Ahr/cm$^2$. The overall average for all the data for these prior art electrodes is about 5.6 Ahr/cm$^2$. The higher lifetime inventive composite diamond electrode that is shown on the same scale does not exhibit any increase in voltage at the end of the trial (10 Ahr/cm$^2$ or 20 hours of testing at 0.5 A/cm$^2$). The lifetime of the inventive films would not be visible on the scale of this graph reflected in the data from Table 1 given their considerably longer HAST lifetimes even under these extreme chemical acceleration conditions.

FIG. 4 presents a schematic image of the inventive composite diamond electrode characterizing the differential Young's modulus between the underlying BD-UNCD and the overlying BD-MCD layers. The Young's modulus of the underlying UNCD layer is less than 900 GPa and the Young's modulus of the overlying MCD layer is greater than 900 GPa. Typical BD-UNCD Young's modulus can be in the range of 550-900 GPa and can be adjusted by adjusting the deposition parameters. The Young's modulus of BD-MCD is closer to that of single crystal diamond (1220 GPa) and is typically in the range of 900-1200 GPa. The combination of the extreme chemical affinity between a BD-MCD diamond layer grown on an existing BD-UNCD layer with the nearly identical linear thermal expansion coefficient between the two layers, i.e. ~1 ppm, provides nearly ideal adhesion between the two diamond layers.

It is well known to those skilled in the art of thin film deposition on metal or silicon electrodes that the use of strain-relieving layers can dramatically impact the quality of additional thin films grown on top of such layers. This is particularly true for the integration of epitaxial layers with substrates in which there is a significant lattice mismatch between the overlayer and electrode substrate. So-called "buffer" layers are used to distribute the stress within the heterostructure to prevent delamination and improve the overall material properties of the overlayer. An underlying diamond layer of BD-UNCD therefore serves the purpose of a "buffer" layer to distribute the deposition stress and stress generated in the layer during usage and thereby improve the overall delamination resistance of the composite film under shear stress which is particularly severe during high current density electrochemical oxidation (anodic oxidation) of a metallic, silicon or dielectric electrode substrates coated with doped diamond.

Without intention of being bound by a particular theory, it is hypothesized that the combination of the strong adhesion between the two diamond layers as deposited on an electrode substrate and the "cushioning" effect of the somewhat "softer" underlying "buffering" BD-UNCD layer provides some of the observed improvement in delamination resistance under shear stress caused by electrochemical oxidation. Additionally, the discontinuity in grain size between the two diamond layers as deposited on an electrode substrates may contribute to a reduction in defect propagation probabilities. Not withstanding the complex potential mechanisms that may contribute to the overall improvement in durability to shear stress, the experimental data indicates an improvement in lifetime under these extreme shear stress conditions of at least 5-10 times over non-composite BD-MCD films of the same or similar thickness as deposited on an electrode substrates. The extreme shear stress under high voltage/current density electrochemical oxidation is sufficient to pulverize even diamond films over time. However, BD-MCD exhibits larger grain sizes and Young's moduli and is therefore expected to exhibit greater resistance to this oxidative shear stress. However, such thick BD-MCD films would be much more expensive to deposit on an electrode substrate, due to their 340 times longer deposition times. The increase in reliability for a given thickness of the inventive composite film therefore offers the advantage of a thinner and less expensive composite diamond electrode for a given application and target reliability.

Alternative embodiments of the inventive diamond electrodes include the use of doped nanocrystalline diamond as the underlying layer and BD-MCD as the overlying layer or BD-UNCD as the underlying layer and BD-MCD as the overlying layer. The use of only two such layers may be sufficient for most applications. However, where extreme reliability or thicker diamond layers are appropriate (e.g. for ozone electrodes or high temperature applications), an additional set of underlying and overlying layers may be appropriate. This could involve a third diamond layer similar in properties (but not necessarily thickness) as the first diamond layer, (e.g. BD-UNCD) and a fourth diamond layer similar in properties (e.g. BD-MCD) to the second overlying layer.

Biomedical applications are appropriate for these composite diamond electrodes given their extreme hardness, bioinertness, chemical resistance and extreme reliability. Such applications could include cardiovascular devices, and other electrochemical or electrode implantables where these extraordinary properties would present an advantage over the prior art. For example, automatic defibrillators require a form of heart surgery to replace batteries. The battery lifetime is severely limited by the build-up of the body's immune system at or near the point of contact between the electrode and the surrounding tissue. The well-known extreme chemical and bioinertness of composite diamond electrodes could present a significant advantage in reducing the body's immunological reaction to the presence of these implantables and should significantly lengthen the useful lifetime of battery power for these devices.

These and other variations and modifications will become apparent to those skilled in the art once the above disclosure is fully appreciated. It is intended that the following claims be interpreted to embrace all such variations and modifications.

What is claimed:

1. An electrochemical system comprising an anode containing a first underlying conductive ultrananocrystalline diamond layer prepared by a deposition technique including a methane to hydrogen ratio of at least 2 to about 10 percent and a pressure in the range of about 1 to about 10 Torr that is deposited directly onto at least one side of a substrate and having a first average thickness and a first average grain size that is less than about 100 nm, and an outermost conductive diamond layer overlying the first diamond layer, the outermost diamond layer having a second average thickness and a second average grain size, wherein the second average grain size is more than three times greater than the first average grain size and the average sp$^2$ content of the first conductive diamond layer is at least five times greater than an average sp$^2$ content of the outermost conductive diamond layer.

2. The electrochemical system of claim 1, wherein the outermost conductive diamond layer is comprised of microcrystalline diamond or nanocrystalline diamond.

3. The electrochemical system of claim 1, wherein the first conductive diamond layer has an average grain size of less than 20 nm.

4. The electrochemical system of claim 1, wherein the outermost conductive diamond layer has an average grain size of greater than 1 μm.

5. The electrochemical system of claim 1, wherein the grain size increases from the first diamond layer to the outermost diamond layer after an interface between the first and the outermost diamond layers.

6. The electrochemical system of claim 1, wherein the first diamond layer is coated on the substrate in a deposition run that includes the outermost diamond layer coated on the first diamond layer, without breaking reactor vacuum.

7. The electrochemical system of claim 1, wherein the first diamond layer is coated on the electrode substrate in a first deposition run followed by the outermost diamond layer coated on the first diamond in a second deposition run separated from the first deposition run.

8. The electrochemical system of claim 1, wherein a resistivity of the first conductive diamond layer is less than 1 ohm-centimeter.

9. The electrochemical system of claim 1, wherein a resistivity of the outermost conductive diamond layer is between 0.001 and 0.1 ohm-centimeter.

10. The electrochemical system of claim 1, wherein the average thickness of the first conductive diamond layer is between 1 and 20 microns.

11. The electrochemical system of claim 9, wherein the average thickness of the first conductive diamond layer is between 2 and 10 microns.

12. The electrochemical system of claim 10, wherein the average thickness of the outermost conductive diamond layer is between 0.5 and 3 microns.

13. The electrochemical system of claim 1, wherein the average thickness of the outermost conductive diamond layer is between 0.5 and 5 microns.

14. The electrochemical system of claim 1, wherein the first conductive diamond layer has an average Young's modulus of less than 900 GPa.

15. The electrochemical system of claim 1, wherein the outermost conductive diamond layer has an average Young's modulus of greater than 900 GPa.

16. The electrochemical system of claim 1, wherein the first conductive diamond layer has an average Young's modulus of less than 800 GPa.

17. The electrochemical system of claim 1, wherein the outermost conductive diamond layer has an average Young's modulus of greater than 1000 GPa.

18. The electrochemical system of claim 1, wherein the average thickness of the first conductive diamond layer is at least two times greater than the average thickness of the outermost conductive diamond layer.

19. The electrochemical system of claim 1, wherein the average thickness of the first conductive diamond layer is at least five times greater than the average thickness of the-outermost conductive diamond layer.

20. The electrochemical system of claim 1, wherein the substrate comprises a non-diamond carbide forming material.

21. The electrochemical system of claim 1, wherein the substrate comprises one or more of niobium, tantalum, tungsten, titanium, molybdenum, zirconium, silicon, silicon carbide, tungsten carbide, pyrolytic carbon or graphite and alloys and mixtures thereof.

22. The electrochemical system of claim 1, wherein both the first and outermost conductive diamond layers are monolithic diamond layers.

23. The electrochemical system of claim 1, wherein an as-deposited average roughness of the first conductive diamond layer is less than 20 nm and an as-deposited average roughness of the outermost conductive diamond is greater than 50 nm.

24. The electrochemical system of claim 1, further comprising at least one additional conductive diamond layer between the first diamond layer and the outermost diamond layer.

25. The electrochemical system of claim 1, wherein the lifetime before delamination failure of the anode at a given current density is at least 5 times greater than the lifetime before delamination failure of a conductive diamond electrode comprised of a single layer of approximately the same thickness as the cumulative thickness of both conductive diamond layers of the anode.

26. The electrochemical system of claim 25, wherein the lifetime before delamination failure of the anode is at least 10 times greater than the time before delamination failure of a conductive diamond electrode comprised of a single layer of approximately the same thickness as the cumulative thickness of both conductive diamond layers of the anode.

27. The electrochemical system of claim 1, wherein the lifetime before delamination failure under constant electrochemical stress of the anode at a current density of 2.5 amps per square centimeter in a predominantly NaCl solution of greater than or equal to 1 molar, is greater than 500 hours.

28. The electrochemical system of claim 27, wherein the lifetime before delamination failure under constant electrochemical stress of the anode at a current density of 2.5 amps per square centimeter in a predominantly NaCl solution of greater than or equal to 1 molar, is greater than 2000 hours.

29. The electrochemical system of claim 1, wherein both the first and the outermost conductive diamond layers are doped with either boron or nitrogen.

30. The electrochemical system of claim 1, wherein the electrochemical system is configured to produce reactive oxygen species such as hydroxyl radicals and/or ozone.

31. The electrochemical system of claim 1, wherein the electrochemical system is configured to produce chlorine and/or hypochlorite.

32. The electrochemical system of claim 1, wherein the electrochemical system is configured to produce peroxodisulphate and/or peroxodicarbonate.

* * * * *